US005387295A

United States Patent [19]

Gibson

[11] Patent Number: 5,387,295

[45] Date of Patent: Feb. 7, 1995

[54] STABILIZERS FOR CROSS-LINKED COMPOSITE MODIFIED DOUBLE BASE PROPELLANTS

[75] Inventor: James D. Gibson, Cumberland, Md.

[73] Assignee: Hercules Incorporated, Wilmington, Del.

[21] Appl. No.: 757,115

[22] Filed: Jan. 5, 1977

[51] Int. Cl.[6] ..... C06B 45/10

[52] U.S. Cl. ..... 149/19.4; 149/198

[58] Field of Search ..... 149/19.4, 19.8

[56] References Cited

U.S. PATENT DOCUMENTS

| | | | |
|---|---|---|---|
| 3,873,386 | 3/1975 | Elrick | 149/19.8 |
| 3,894,894 | 7/1975 | Elrick | 149/19.4 |
| 4,045,261 | 8/1977 | Baczuk | 149/19.8 |

OTHER PUBLICATIONS

Eastes et al., *J. Chem. Soc. (B)*, 1969 (8), 922–8.

*Chem. Abs.*, 8th Collective Index, Formula Index, p. 2495f (1967–1971).

*Primary Examiner*—Edward A. Miller

*Attorney, Agent, or Firm*—Mark Goldberg

[57] ABSTRACT

Stabilizers for isocyanate cross-linked composite modified double base propellants are provided. These stabilizers have good solubilities in the propellant matrices and have good stabilization properties. The stabilizers of this invention are compounds of the formula:

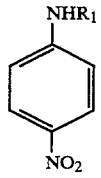

wherein $R_1$ is selected from the group consisting of:

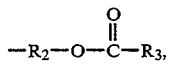

(a)

$-R_2-O-R_3$, (b)

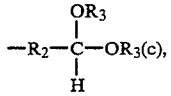

(d)

and

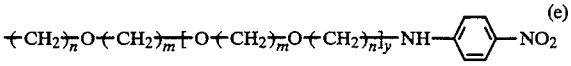

(e)

wherein $R_2$ is a straight or branched chain alkene radical having 1 to 3 carbon atoms, $R_3$ is a straight or branched chain alkyl radical having 1 to 3 carbon atoms, n is an integer from 1–3, m is an integer from 1–3, and y is an integer from 1–3.

7 Claims, No Drawings

STABILIZERS FOR CROSS-LINKED COMPOSITE MODIFIED DOUBLE BASE PROPELLANTS

This invention relates to stabilizers for cross-linked composite modified double base (XLDB) propellants. More particularly, this invention relates to stabilizers for XLDB propellants, which stabilizers are substituted para-nitroaniline compounds.

BACKGROUND OF THE INVENTION

In double base propellant systems comprising nitrocellulose and an energetic plasticizer such as nitroglycerin, stabilizers are employed to react with products resulting from degradation of the propellant to reduce formation of gases resulting from the gradual degradation of the propellant with time. In XLDB propellants, stabilizers commonly employed in double base propellants such as resorcinol have been found to react with isocyanate cross-linking agents employed to cross-link the nitrocellulose component of the propellants. As a result of this reaction, it is difficult to predict the amount of isocyanate cross-linking agent required to produce the desired physical properties of resorcinol stabilized XLDB propellant.

An improved stabilizer for XLDB propellant in which an isocyanate is the cross-linking agent, is N-methyl-p-nitroaniline (MNA). While this stabilizer does not interfere with the cross-linking reaction between isocyanate cross-linking agents and nitrocellulose, its solubility in the liquid components employed in preparation of the composition, such as the energetic plasticizer, limits the amount of this stabilizer which can be employed. If a stabilizer is employed in an XLDB propellant in an amount exceeding its solubility in the propellant matrix, it will crystallize from the matrix and adversely effect the physical properties of the resulting propellant. With low amounts of stabilizer in XLDB propellants, the service life of these propellants as evaluated during storage at temperature extremes of intended use are substantially reduced.

SUMMARY OF THE INVENTION

In accordance with this invention, it has been found that certain para-nitroaniline compounds are effective stabilizers for XLDB propellants and are capable of extending the service life of such XLDB propellants. The stabilizers of this invention are particularly useful in XLDB propellant compositions having a high solids content and a low liquid nitroester content. The stabilizers of this invention are compounds of the following formula (I):

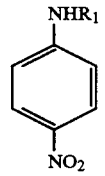

(I)

wherein $R_1$ is selected from the group consisting of:

$$-R_2-O-\overset{\overset{\displaystyle O}{\|}}{C}-R_3, \quad \text{(a)}$$

$$-R_2-O-R_3, \quad \text{(b)}$$

-continued $$-R_2-\underset{\underset{\displaystyle H}{|}}{\overset{\overset{\displaystyle OR_3}{|}}{C}}-OR_3 \text{(c)},$$

$$-\underset{\underset{\displaystyle H}{|}}{\overset{\overset{\displaystyle R^3}{|}}{C}}-R_3, \quad \text{(d)}$$

and

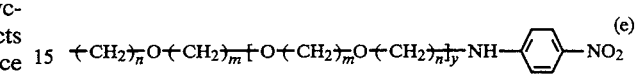

(e)

wherein $R_2$ is a straight or branched chain alkene radical having 1 to 3 carbon atoms, $R_3$ is a straight or branched chain alkyl radical having 1 to 3 carbon atoms, n is an integer from 1–3, m is an integer from 1–3, and y is an integer from 1–3.

Illustrative stabilizers conforming to formula I above are N-(2-methoxyethyl)-p-nitroaniline; N-(2,2-dimethoxyethyl)-p-nitroaniline; N-(2-acetoxyethyl)-p-nitroaniline; N-isopropyl-p-nitroaniline; 1,5-bis(4-nitrophenyl)-1,15-biaza-4,7,10 -trioxapentadecane, and the like.

The stabilizers of this invention can be prepared by the general reaction of 4-fluoronitrobenzene and a substituted amine:

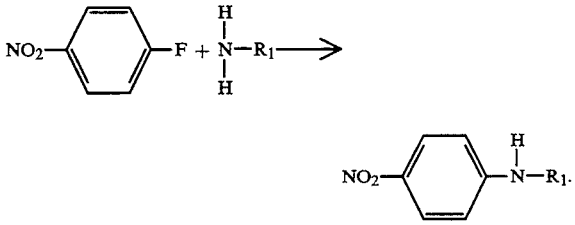

EXAMPLES

The stabilizers of this invention and XLDB propellants stabilized therewith are illustrated in the examples which follow. In these examples and in this specification and claims, parts and percentages are by weight unless otherwise specified.

The following example illustrates preparation of N-(2-methoxyethyl)-p-nitroaniline (MENA).

EXAMPLE 1

Fourteen hundred grams of dimethylsulfoxide was charged to a 5-liter, 4-neck flask equipped with a liter dropping funnel, thermometer, air stirrer and condenser. About 1575 grams (21 moles) of 2-methoxyethylamine was dissolved in the dimethylsulfoxide in the reaction vessel. The reaction vessel was heated to 45° C. and then 987 grams (7 moles) of 1-fluoro-4-nitrobenzene was slowly added from the dropping funnel to the mixture in the reaction vessel over a period of 3 hours. The temperature of the resulting reaction mass was maintained between 50° and 60° C. during the addition period. The temperature and stirring of the reaction mass were maintained for 4 hours after the addition was complete. The resulting product was slowly poured into a stirred quantity of 8 liters of water and further stirred for 15 minutes. A solid precipitated from the mixture and the solid was filtered through a sintered glass filter. This product was washed twice with water, once with 5% hydrochloric acid, and then washed 3 additional times with water. The product was dried overnight for 17 hours in an oven at a temperature of 60° C. The dried product yield was 1702 grams or 98.5% of theoretical yield. The melting point of the product was 83°–86° C. and the product was identified by IR spectroscopy as N-(2-methoxyethyl)-p-nitroaniline.

The following example illustrates preparation of N-(2,2-dimethoxyethyl)-p-nitroaniline (DNA).

EXAMPLE 2

One hundred and twenty grams of dimethylsulfoxide was charged to a 500 ml. 3-neck flask equipped with a thermometer, condenser, dropping funnel, and a magnetic stirrer. About 189 grams (1.8 moles) of aminoacetaldehyde dimethylacetal was dissolved in the dimethylsulfoxide. The mixture was heated to 50° C. Then 84.7 grams (0.6 mole) of 1-fluoro-4-nitrobenzene was slowly added to the mixture from the dropping funnel over a period of 1 hour. During the time of addition of the 1-fluoro-4-nitrobenzene, the reaction mixture was continuously stirred and the temperature was maintained between 50° C. and 64° C. Following the addition of the 1-fluoro-4-nitrobenzene, the resulting reaction mass was maintained at 60° C. for 3 hours and 45 minutes. The reaction mass was then poured into 750 ml. of water. A solid product precipitated and the product was filtered in a sintered glass filter. This product was washed 3 times by slurrying with about 200 ml. of water in the filter and filtering. The product was then slurried with 200 ml. of 5% hydrochloric acid and again filtered. Following washing with hydrochloric acid the product was washed 3 additional times with 200 ml. of water each time. The washed product was dried in an oven at a temperature of 60° C. for 18 hours. The dried product (117 grams) was recovered and was recrystallized by dissolving the product in 350 ml. of benzene. The benzene solution was poured into a stirred quantity of 1400 ml. of cyclohexane. A solid product precipitated and the product was filtered and washed 3 times with 550 ml. of a solution comprising 110 ml. of benzene and 440 ml. of cyclohexane. The product was filtered and 102.8 grams of solid product was recovered. The melting point of the product was 69°–70° C. and the product was identified by IR spectroscopy as N-(2,2-dimethoxyethyl)-p-nitroaniline.

The following example illustrates preparation of N-(2-acetoxyethyl)-p-nitroaniline (ANA).

EXAMPLE 3

About 81 grams (1.2 moles) of 95% ethanolamine and 80 grams of dimethylsulfoxide were added to a 500 ml. 3-neck flask equipped with a thermometer, condenser, dropping funnel and magnetic stirrer. These materials were mixed and the mixture was heated to 50° C. About 56.5 grams (0.4 mole) of 1-fluoro-4-nitrobenzene was slowly added to the ethanolamine-dimethylsulfoxide mixture from the dropping funnel over a period of 1 hour. During the time of addition, the reaction temperature was maintained between 50° C. and 60° C. After addition of the 1-fluoro-4-nitrobenzene was complete, the temperature of the reaction mass was maintained at 50°–55° C. for 3 hours. The resulting solution was then slowly poured into 500 ml. of stirred water. A solid product precipitated and the solid product was filtered and washed 5 times with 100 ml. of water. A solid product was dried for about 4 hours in a vacuum desiccator at 60° C. The yield of product was 69.1 grams. The melting point of the product was 107.5–110° C. and the product was identified by IR spectroscopy as N-(2-ethanol)-p-nitroaniline (ENA).

To a 250 ml. 3-neck flask equipped with a thermometer, condenser, dropping funnel and magnetic stirrer was added 45.6 grams (0.25 mole) of the N-(2-ethanol)-p-nitroaniline (ENA) dissolved in 100 grams (1.27 moles) of pyridine. Then 20.4 grams (0.26 mole) of acetyl chloride was added to the mixture with stirring over a period of 1 hour. The temperature of the resulting reaction mass was maintained at 30°–40° C. during this reaction period. During the time the acetyl chloride was being added, 40 ml. (0.49 mole) of pyridine was also added to the reaction mass to maintain reaction products in solution. Following the reaction period, the reaction mixture was added to 1250 ml. of water with stirring. A solid product precipitated and the product was filtered in a sintered glass filter. The product was washed twice by slurrying with water on the filter, washed once with 2% hydrochloric acid, and washed 3 additional times by slurrying with water on the filter. The product was dried at 60° C. under vacuum for 1½ hours. The dried product yield was 50.5 grams. The melting point of the product was 115°–119° C. and the product was identified by IR spectroscopy as N-(2-acetoxyethyl)-p-nitroaniline (ANA).

EXAMPLES 4–9

The following examples illustrate the effectiveness of thermal stabilizers of this invention on the gassing rate of an XLDB test propellant in which they are incorporated. The XLDB test propellant composition (except for identification of the stabilizer which is set forth in Table 2) subjected to tests to determine the effectiveness of the thermal stabilizers of this invention is set forth in Table 1 below.

TABLE 1

| Propellant Ingredient | Weight Percent |
|---|---|
| Nitroglycerin | 64.75 |
| Nitrocellulose | 8.03 |
| Hydroxy-terminated Prepolymer | 15.77 |
| Isocyanate Cross-linker | 1.25 |
| Nitrodiphenylamine | 1.60 |
| Thermal Stabilizer | 2.60 |
| Oxidizer Solids | 4.0 |
| Fuel | 2.0 |
| Dibutyl tin diacetate (DBTDA) | 0.003 |

Comparison of the stability to degradation of XLDB propellant containing the stabilizers of this invention is set forth in Table 2. In Table 2 the thermal stabilizers employed in the examples are identified by chemical name.

The XLDB test propellant defined in Table 1 is evaluated for stability based upon gassing rates of the propellant. For evaluation tests the XLDB test propellant samples were prepared by first adding a lacquer mix containing the nitroglycerin, nitrocellulose, hydroxy-terminated prepolymer, and nitrophenylamine to a 10 gram propellant mixer and sequentially adding to the lacquer mix the thermal stabilizer, oxidizer solids, fuels and DBTDA. Mixing was continued under vacuum. The resulting propellant slurry was added to a hypodermic syringe, from which 1 gram samples were added to glass gassing tubes. The gassing tube is a 1-inch spherical bulb attached to a 5.5 inch, 7 mm O.D. tube, by means of a Teflon tube attached to the syringe. The gassing tube containing the propellant sample was evacuated for 18 hours and each gassing tube was sealed under vacuum behind a protective shield by an oxygen-gas torch. Six gassing tubes for each propellant were charged with a propellant sample and were placed in a 70° C. bath and the gassing tubes were withdrawn from the bath after 4, 8, 18, 25, 40, and 60 days, respectively. The degradation of propellant results in gas formation and the pressure of the gas in each tube was determined and the composition of the gas from each tube was analyzed by a mass spectrometer. The final composition of the gas was calculated to determine the volume of $N_2$, NO and $CO_2$ per gram of propellant sample.

TABLE 2

| Example No. | Stabilizer[b] | Propellant Gassing Rates at 70° C. $N_2$ cc × $10^3$ (gram)(day) | NO | $CO_2$ | Effective Gassing Rate $N_2 + NO/2 + CO_2/50$[a] cc × $10^3$ (gram)(day) |
|---|---|---|---|---|---|
| 4 | IPNA | 1.0 | 0.15 | 1.3 | 1.10 |
| 5 | ANA | 1.3 | 0.14 | 2.8 | 1.43 |
| 6 | MENA | 1.3 | 0.33 | 2.7 | 1.52 |
| 7 | DNA | 1.9 | 0/0 | 10.2 | 2.10 |
| 8 | MNA (control) | 2.8 | 0.0 | 2.7 | 2.85 |
| 9 | RES (control) | 4.3 | 5.0 | 5.2 | 6.90 |

[a]Effective gassing rate is measured as a pressure factor in which relative gas solubilities are considered. NO is twice as soluble as $N_2$ and $CO_2$ is fifty times as soluble. Effective gassing rate is therefore measured using the above factors to correct for solubility.
[b]IPNA is N-isopropyl-p-nitroaniline
ANA is N-(2-acetoxyethyl)-p-nitroaniline
MENA is N-(2-methoxyethyl)-p-nitroaniline
DNA is N-(2,2-dimethoxyethyl)-p-nitroaniline
MNA is N-methyl-p-nitroaniline
RES is resorcinol

EXAMPLES 10–15

The following examples illustrate the improvement in time to acceleration of gassing and time to failure of an Analog Motor utilizing the stabilizers of this invention.

TABLE 3

| Propellant Composition (%) | Example: 10 (Control) | 11 | 12 | 13 | 14 |
|---|---|---|---|---|---|
| Binder (NC, NG, prepolymer) | 40.8 | 39.8 | 39.8 | 38.8 | 38.8 |
| Stabilizers[a] | | | | | |
| MNA | 1.0[b] | — | — | 1.0 | 1.0 |
| IPNA | — | — | 2.0 | — | 2.0 |
| MENA | — | 2.0 | — | 2.0 | — |
| Oxidizers, Fuels, Ballistic Modifiers, etc. | 58.2 | 58.2 | 58.2 | 58.2 | 58.2 |
| Time to Acceleration of Gassing Rate at 165° C., Days | 31 | 35 | | | |
| Time to Failure of Analog Motor, Days | | | | | |
| 165° F. | 33 | | | 43 | 58 |
| 145° F. | 110 | | 230 | 255 | |

[a]Defined below Table 2
[b]MNA crystallizes out of propellant of Example 10 when employed in amounts of 1.1% and above. Propellants containing 2% MNA have poorer times to acceleration of gassing rate and time to failure of analog motor than the same propellant containing 1% MNA.

The stabilizers of this invention are employed in XLDB propellant in amounts of from about 1 to about 5% by weight based on the weight of the propellant composition. The weight percent of stabilizer employed in XLDB propellants and the choice of the particular stabilizer within the scope of this invention which is employed in a particular propellant depends, in part, upon the trade-off which is acceptable between specific impulse of the XLDB propellant which decreases with increased percentages of stabilizer in the propellant and long term stability at temperature extremes of use which increases with increased percentages of stabilizer in the propellant.

The XLDB propellants in which the stabilizers of the invention are employed can have numerous compositions, provided that they must contain nitrocellulose, a hydroxy-terminated prepolymer, and a liquid nitroester such as nitroglycerin as the principal propellant binder components and are cross-linked with a diisocyanate such as, for example, toluene diisocyanate, hexamethylene diisocyanate, and the like. The hydroxy-terminated prepolymers which can be employed in XLDB propellant include, without limitation, hydroxy-terminated rubbers such as hydroxy-terminated polybutadiene. Other hydroxy-terminated rubbers, however, can be employed as the prepolymer. The XLDB propellants may contain organic and inorganic oxidizing agents, such as ammonium perchlorate, sodium perchlorate, cyclotrimethylene trinitramine (RDX) and cyclotetramethylene tetranitramine (HMX), and the like. In addition, XLDB propellant may contain ballistic modifiers, fuels, curing catalysts, and the like.

What I claim and desire to protect by Letters Patent is:

1. In a cross-linked composite modified double base propellant composition comprising nitrocellulose, nitroglycerin, hydroxy-terminated prepolymer, oxidizers, isocyanate cross-linking agent and stabilizing agents, the improvement comprising a stabilizing agent of the formula:

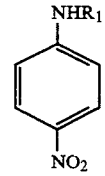

wherein $R_1$ is selected from the group consisting of:

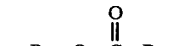

(a)

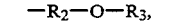

(b)

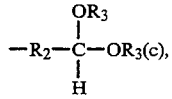

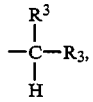

(d)

and

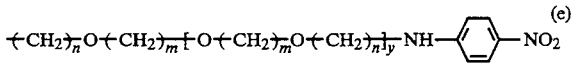

(e)

wherein $R_2$ is a straight or branched chain alkene radical having 1 to 3 carbon atoms, $R_3$ is a straight or branched chain alkyl radical having 1 to 3 carbon atoms, n is an integer from 1–3, m is an integer from 1–3, and y is an integer from 1–3.

2. An isocyanate cross-linked composite modified double base propellant composition containing from about 1% to 5% by weight, based upon the weight of the propellant composition, of a thermal stabilizer of the formula:

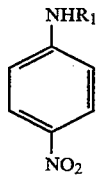

wherein $R_1$ is selected from the group consisting of:

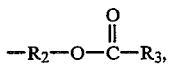

(a)

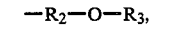

(b)

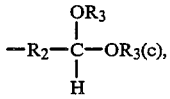

(d)

and

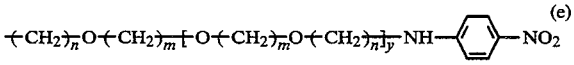

(e)

wherein $R_2$ is a straight or branched chain alkene radical having 1 to 3 carbon atoms, $R_3$ is a straight or branched chain alkyl radical having 1 to 3 carbon atoms, n is an integer from 1–3, m is an integer from 1–3, and y is an integer from 1–3.

3. A propellant composition of claim 2 in which the thermal stabilizer comprises:

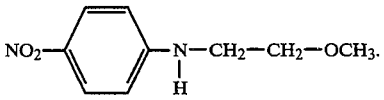

4. A propellant composition of claim 2 in which the thermal stabilizer comprises:

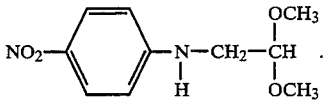

5. A propellant composition of claim 2 in which the thermal stabilizer comprises:

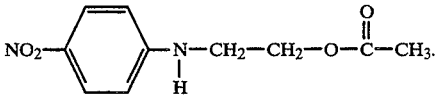

6. A propellant composition of claim 2 in which the thermal stabilizer comprises:

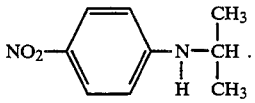

7. A propellant composition of claim 2 in which the thermal stabilizer comprises:

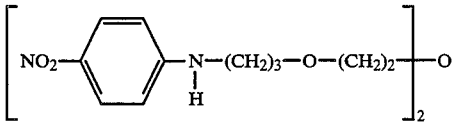

* * * * *